United States Patent [19]

Emery

[11] 4,123,334

[45] Oct. 31, 1978

[54] RECIPROCATING COKE GUIDE EXTENSION

[75] Inventor: William G. Emery, Pittsburgh, Pa.

[73] Assignee: Koppers Company, Inc., Pittsburgh, Pa.

[21] Appl. No.: 867,680

[22] Filed: Jan. 9, 1978

[51] Int. Cl.[2] ..... C10B 33/14

[52] U.S. Cl. ..... 202/262; 105/254; 193/3; 214/18 R; 214/41 R

[58] Field of Search ..... 202/262, 263; 214/18 R, 214/23, 35 R, 41 R; 193/3, 5, 22, 23, 31 R; 105/252, 254, 256, 276, 279; 298/7, 8 R

[56] References Cited

U.S. PATENT DOCUMENTS

| | | | |
|---|---|---|---|
| 539,646 | 5/1895 | Rodenhausen | 193/31 R |
| 1,724,548 | 8/1929 | Barcus | 193/22 X |
| 1,917,247 | 7/1933 | Good | 214/35 R |
| 2,166,593 | 7/1939 | McIntosh | 214/18 R |
| 4,053,068 | 10/1977 | Gidick | 202/262 X |

*Primary Examiner*—Morris O. Wolk
*Assistant Examiner*—Roger F. Phillips
*Attorney, Agent, or Firm*—R. Lawrence Sahr; Oscar B. Brumback

[57] ABSTRACT

In a system wherein coke is ejected from a horizontal coke oven into a one-spot coke quenching car, a reciprocating coke guide extension which serves to spread the ejected coke more evenly throughout the one-spot quenching car, thus allowing more coke to be accumulated in the one-spot quenching car before it is required to be moved. The apparatus presents a means by which the falling coke column is directed initially to the remote side of the car, away from the coke oven, and at varying oblique angles from the central axis of the horizontal coke oven, concluding the loading operation by directing the coke to a point immediately below the exit from the coke oven.

12 Claims, 2 Drawing Figures

RECIPROCATING COKE GUIDE EXTENSION

BACKGROUND OF THE INVENTION

1. Field of the Invention

The present invention relates to the means for utilizing the concept of a one-spot coke quenching car to accept the coke pushed from the coke ovens of a horizontal coke oven battery and, more particularly, the means by which a coke oven can be completely discharged into a coke quenching car without moving the car.

2. Description of the Prior Art

Historically, horizontal coke oven batteries have been discharged from the coke side of a coke oven after the cooking process has been completed. A pusher machine is aligned with the coke oven on the opposite side of the coke oven battery from the coke side, i.e. the pusher side. The pusher machine pushes the coke through the length of the coke oven, discharging it at the coke side of the battery. Some means for guiding the discharging coke is positioned adjacent to the coke side of the coke oven battery. Conventionally this is a machine, riding on rails which run perpendicular to the direction of push, called a coke guide car (although it may perform additional functions such as removing and replacing the coke oven doors and sometimes cleaning those doors as well as the coke oven door jambs). The guide means on the coke guide car is no more than a chute aligned with the longitudinal axis of the coke oven, with sides and a floor that correspond dimensionally to the size of the coke oven doors.

The coke guide or chute serves as a conduit for the discharged coke into the top of the open hopper of a coke quench car. The coke quench car is located, by a locomotive, parallel to the coke side of the coke oven battery below the level of the floor of the coke guide and the coke oven to receive the incandescent coke as it is discharged. Past practice has been to slowly move the car along the coke side of the oven as the coke is discharged. The car is moved so the coke will, more or less, be evenly distributed from end to end of the hopper.

The increasing awareness of the pollution problems historically attendant to coke oven operations promoted advances in technology directed toward abatement of that pollution. Noxious gases were found to be escaping from the hot coke as it was being discharged from the coke oven. The direction taken to overcome this problem has been toward containment of the gases within a closed system followed by neutralization of the polluting qualities of those gases. One of the prominant methods of introducing a closed system is to place a hood over the whole process of discharging the coke from the oven into a likewise enclosed hopper of a coke quench car. The hood is evacuated of noxious gases by fans which transfer the gases to a means for treating them to remove pollutants. But to make this sytem feasible, the coke quench car no longer can be moved during the coke discharge. Thus developed the nomenclature of a "one-spot" coke quench car, i.e., a quench car which is stationarily positioned during the discharge of incandescent coke from a coke oven.

To accommodate the "one-spot" situation various designs of coke quench car hoppers have been devised, none of which has proved wholly satisfactory in attaining an even distribution of coke within the hopper of a one-spot quench car. Thus the design of the cars has generally progressed toward shorter, but wider and deeper quench car hoppers to accommodate the push from a full coke oven at a single spotting. However, the larger the car, the more it costs to build and the more the space needed to operate it. Such a direction in design produces diminishing returns in terms of economics.

There is need for a means to evenly distribute discharging coke within a one-spot quench car which allows utilizatin of standard sized quench cars but still allows containment of pollution.

SUMMARY OF THE INVENTION

The present invention is directed to improvements in the means of dispersing discharged coke as it is being guided into a one-spot coke quench car. An extension is mounted onto the end of the coke guide which is remote from the coke oven. A wing is pivotally mounted to each vertical wall of the coke guide, extending the coke guide walls further outward to a position centrally above the location of the hopper of a one-spot coke quench car. The wings can be pivoted rearwardly to remove them from the path of travel of the locomotive as it removes the one-spot quench car after it is loaded. A floor extension extends the coke guide floor, likewise, outward to a position above and closer to the centerline of the hopper of the one-spot quench car. The floor extension can also be retracted from the locomotive's path of travel. The floor extension is wide enough to enclose the full pivotation arc of both wings so that at any combination of positions of the wings, the floor extension is available to support the discharged coke as it passes through the coke guide extension.

The function of the wings is to alter the path of travel of the coke. A means of pivotation directs the movement of each wing to alter the direction of travel of the coke as it cascades into the one-spot quench car directing it first towards one end of the car then, in a fan pattern towards the other end of the car. As this point the floor extension is partially retracted. Finally, both wings are opened wide, the floor extension is fully retracted and the last of the coke falls directly in front of the coke guide. The result of the sequence of operation is to evenly fill the one-spot quench car hopper with the full volume of coke contained in a given coke over, without moving the car.

Accordingly, one of the principal features of the present invention is to provide a means of evenly distributing the coke within a one-spot quench car.

Another feature of the present invention is to reduce the size of the hopper required to accept the full volume of coke from a coke oven by efficient economy of utilization of space within the hopper.

Another feature of the present invention is to provide a means by which a coke quench car can be stationarily positioned to accept the full volume of coke from a coke oven.

Still another feature of the present invention is to provide a means by which it becomes commercially possible to totally enclose the discharge system of a coke oven battery.

These and other features of the present invention will be more completely disclosed and described in the following specification, the accompanying drawing and the appended claims.

DETAILED DESCRIPTION

Figure 1:
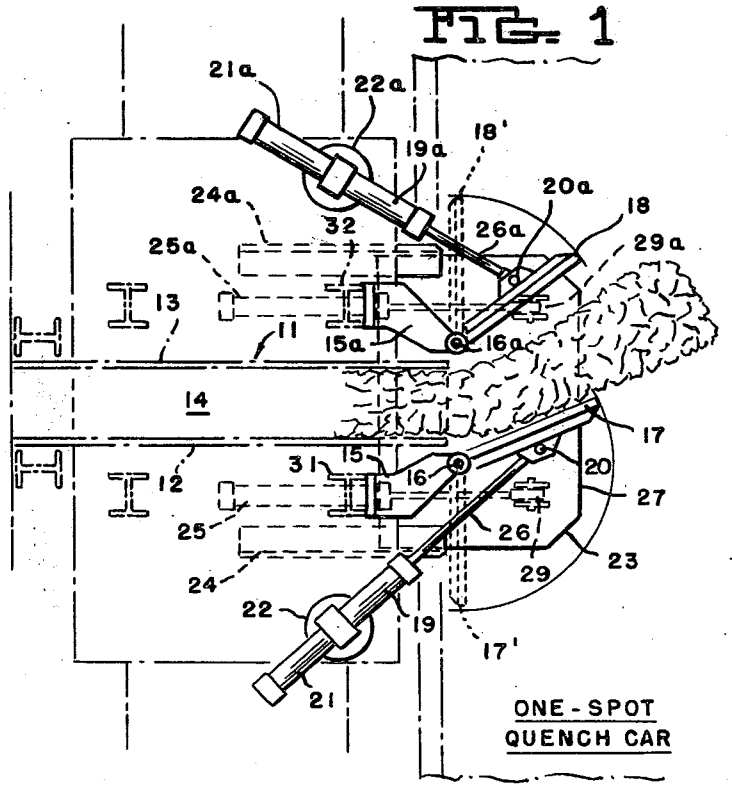
FIG. 1 is a top view of the coke guide extension with a schematic representation of the pivotation arcs of each wing, and the floor extension fully extended.

Referring to the drawings, there is illustrated a coke guide, generally designated by the numeral 11, as mounted on a coke guide car in the conventional manner, formed of a vertical right wall 12 and a vertical left wall 13 both connected along their lower edges to a horizontal floor 14. A set of hinges 15 and 15*a* is fixed, each to a corresponding structural upright 31 and 32, respectively, positioned adjacent the right wall 12 and the left wall 13, respectively, as shown in FIG. 1. The pivotal trunnions 16 and 16*a* of each set of hinges 15 and 15*a* are aligned to form a single axis of pivotation for each set of hinges 15 and 15*a*. A right wing 17 and a left wing 18, respectively, are fixed to each set of hinges 15 so that the right wing 17 and the left wing 18 can pivot about the edges of the right wall 12 and the left wall 13, respectively, as illustrated in the drawings. The right wing 17 and left wing are vertical members extending to a height approximately 60% to 80% of the height of the right wall 12 and left wall 13. The widths of the right wing 17 and left wing 18 are about 4 feet. The right and left walls 12 and 13 are approximately equal to each other in height and to the height of the particular oven to which they correspond. A pair of conventional double acting hydraulic wing cylinders 19 and 19*a* are pivotally mounted, at their extensible ends 20 and 20*a*, one each to the longitudinal centerlines of the left wing 18 and the right wing 17, respectively, approximately one third of the distance from their bottom edges. The wing cylinder bodies 21 and 21*a* are pivotally mounted to vertical stanchions 22 and 22*a*, positioned one on the right side of the coke guide 11 and one on the left side of the coke guide 11, respectively. Each stanchion 22 is fixed at its base to the coke guide car.

Positioned coextensive to the floor 14 of the coke guide 11 is a floor extension 23 mounted to extend and retract an extension guides 24 and 24*a*. The extension guides 24 and 24*a* are fixed to the coke guide car, one on either side of the coke guide 11, and are linearly parallel to the coke guide 11. The floor extension 23 is sufficiently wide, in dimension perpendicular to the length of the coke guide 11, to include the width of both the right wing 17 and left wing 18, as well as the width of the coke guide 11. The length of the floor extension is sufficient to substantially encompass the pivotational arcs of the right and left wings, 17 and 18, at its fully extended position, as illustrated in the drawings, while maintaining sufficient connection with the extension guides 24 to provide lateral stability.

A pair of double acting hydraulic floor cylinders 25 and 25*a* of conventional design are fixed to the coke guide car, positioned parallel to the coke guide 11 and aligned with the plane of the floor extension 23. Cylinder rods 26 and 26*a* are extensibly mounted within the floor cylinders 25 and 25*a*, respectively, in the conventional manner. The remote ends of the cylinder rods 26 and 26*a* are connected adjacent to the leading edge 27 of the floor extension 23 at floor brackets 29 and 29*a*, respectively, equidistant from the longitudinal centerline of the floor extension 23 as illustrated is FIG. 1.

Figure 2:
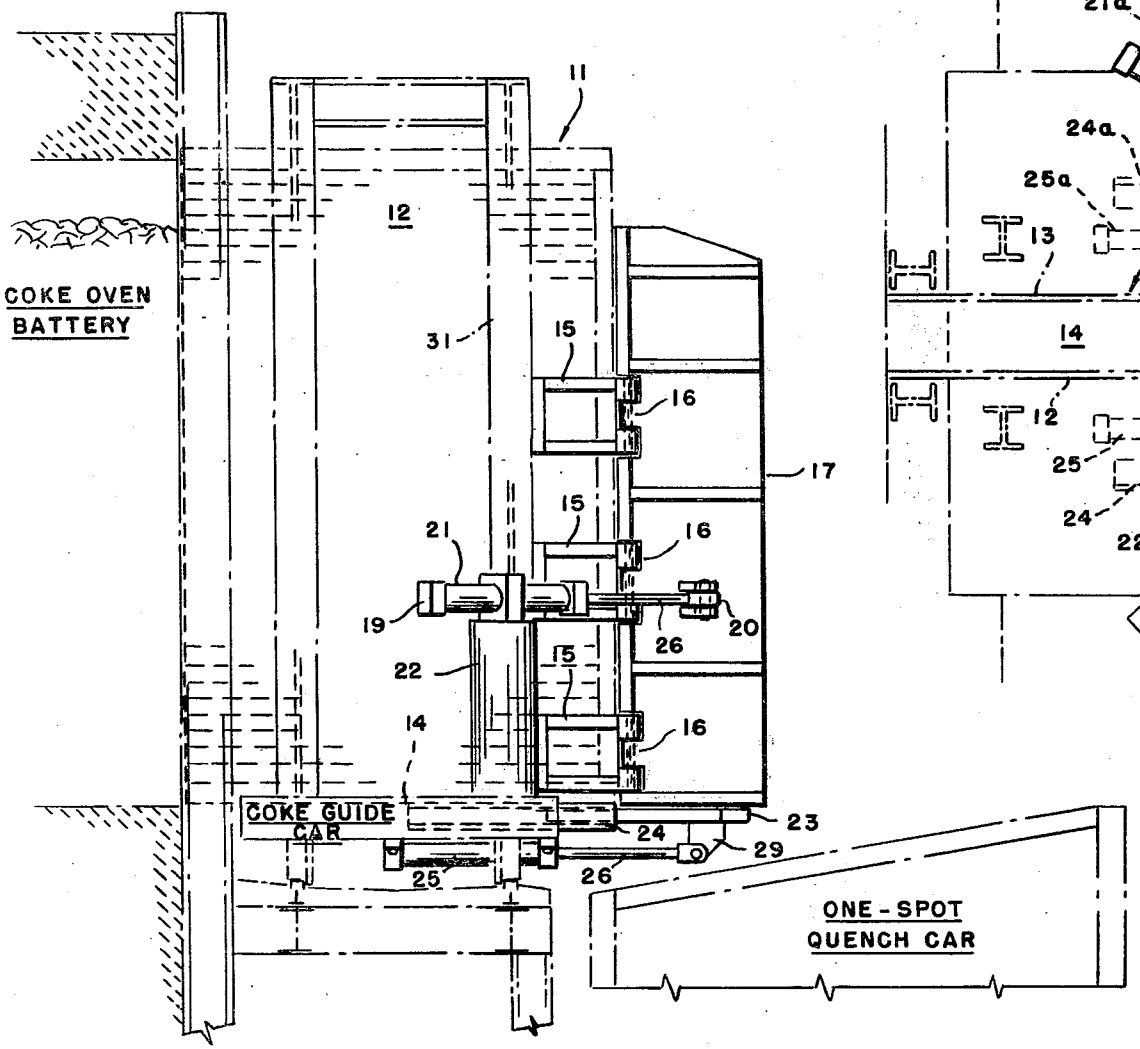
FIG. 2 is a side view of the coke guide extension with the floor extension fully extended.

When the coking process has been completed within a given coke oven, the coke guide car is positioned in front of the coke side door to that oven. The door has already been removed and the coke guide 11 is aligned with the door. A one-spot quench car is centered to the coke guide 11, alongside the coke guide car but at a lower level, the top of the hopper of the one-spot quench car being just below the level of the coke guide 11, as shown in FIG. 2.

A pusher machine (not shown) on the opposite side of the coke oven battery commences to push the coke through the oven into the coke guide 11. The coke emerges as one large block, up to eighteen inches wide, 10 to 22 feet high and the length of the coke oven. The block is incandescent, its temperature exceeding 1500° F. on discharge from the coke oven.

At the commencement of the pushing operation, the floor extension 23 is fully extended along its extension guides 24 and 24*a* by the full extension of the cylinder rods 26 and 26*a* of the floor cylinders 25 and 25*a* having pushed on the floor brackets 29 and 29*a* which are mounted onto the underside of the floor extension 23.

Referring to FIG. 1, right wing 17 is extended from position 17', shown in phantom outline, to the position shown in bold. Left wing 18 is extended from position 18', also shown in phantom outline, to the position shown in bold. Left wing 18 is not extended as far as right wing 17, being only extended to a position of being at an acute angle to the plane of right wing 17 and is not parallel thereto, thus providing a passageway for the hot coke which increases in width as the coke moves toward the leading edge 27 of the floor extension 23. This arrangement provides a relief of pressure as the flow direction of the hot coke changes.

As implied previously, the hot coke moves through the coke guide 11 and between the right wing 17 and left wing 18, being supported by the floor extension. At the point where about one third of the coke from the oven has been discharged, the right wing 17 and left wing 18 commence movement, in unison, to the right, the right wing 17 being retracted and the left wing 18 being extended. This unison motion is relatively slow, extending for the time required to discharge the second third of coke in the oven. The relative positions of the right wing 17 and left wing 18 at the end of the unison motion, being that point at which two thirds of the coke has been discharged from the oven, are reversed from that shown in FIG. 1. The right wing 17 is withdrawn to a position of extension equivalent to that shown for left wing 18 in FIG. 1. And the left wing 18 is further extended to an equivalent extent of that shown for right wing 17 in FIG. 1. The right wing 17 and left wing 18 remain in this position for the balance of the push.

At the point where about 10% of the coke remains to be discharged, the floor extension 23 is withdrawn by retraction of cylinder rods 26 and 26*a* of the floor cylinders 25 and 25*a*, respectively. A portion of the balance of the coke being discharged drops into the quench car immediately beneath the position previously occupied by the floor extension 23. Thus the coke has been evenly distributed in the quench car.

After all of the coke has been discharged, both right wing 17 and left wing 18 are fully retracted to provide clearance for a locomotive (not shown) to move the quench car to the quenching station (not shown).

An alternate method of utilizing the apparatus of the invention is as follows: Initially the left wing 18 is pivoted, by its corresponding wing cylinder 19*a*, to a position perpendicular to the coke guide 11. In this position the wing cylinder 19*a* is completely retracted, the corresponding extensible end 20*a* being positioned adjacent to its wing cylinder body 21*a* and the wing cylinder body 21*a* having pivoted on its stanchion 22*a* to align with the point at which the extensible end 20*a* is pivotably connected to the left wing 18. The right wing 17 is pivoted to an approximate 30° left angle to the right wall 12 by its corresponding wing cylinder 19. In this position the wing cylinder is fully extended, the wing cylinder body 21 having pivoted on its stanchion to align at which the extensible end 20 is pivotally connected to the right wing 17. The floor extension 23 is fully extended along its extension guides 24 by the full extension of the cylinder rods 26 of the floor cylinders 25 having pushed on the floor brackets 29 which are mounted onto the underside of the floor extension 23.

The discharging incandescent coke moves through the coke guide 11 and is diverted to the left as it comes into contact with the right wing 17. The impact of the coke on the right wing 17 causes the coke to break off in blocks approximating five feet in length which move to the left across the floor extension 23, falling into one end of the one-spot quench car. The left wing 18 is then gradually pivoted by its corresponding wing cylinder 19*a* to a point where it forms a 30° left angle to the left wall 13 at which point it is parallel to the right wing 17. The pivotation of the left wing 18 directs the coke towards a lesser angle to the coke guide 11. At the point where the right wing 17 and left wing 18 are positioned at 30° left angles to the coke guide 11, both wings, 17 and 18, gradually pivot to the right, parallel to each other to a point where they are at 30° right angles to the coke guide 11. The angle of direction of the coke changes through the arc of pivotation of the parallel right and left wings, 17 and 18. At the point where the right and left wings, 17 and 18, are parallel and form a 30° right angle to the coke guide 11 the pivotation of the left wing 18 ceases while the right wing 17 continues to be pivoted by its corresponding wing cylinder 19 to a point where it is perpendicular to the coke guide 11. At this point the coke is directed towards the right end of the one-spot quench car across the floor extension 23 in a manner similar to that of the initial positioning of the right and left wings, 17 and 18.

Finally, the left wing 18 is pivoted back to its initial position perpendicular to the coke guide 11. Concurrently the floor extension 23 is retracted on the extension guides 24 by the withdrawal of the cylinder rods 26 into the floor cylinders 25. This causes the remainder of the discharging coke to fall directly from the coke guide 11, centrally, into the one-spot quench car.

Another alternate mode of operation is to initially position the right and left wings, 17 and 18, parallel to each other at an approximate 45° left angle to the coke guide 11. The wings, 17 and 18, are then pivoted to the right at equal rates until they reach an approximate 45° right angle to the coke guide 11. The floor extension 23 is then partially withdrawn and the wings, 17 and 18, are pivoted, parallel to each other, to the left until the initial position is reached. The floor extension 23 is further withdrawn and the cycle is repeated until all of the discharging coke is in the one-spot quench car.

According to the provisions of the patent statutes, the principle, preferred construction and mode of operation of the present invention have been explained, and what is considered to be its best embodiment has been illustrated. However, it is to be understood that, within the scope of the appended claims, the present invention may be practiced otherwise than as specifically illustrated and described.

What is claimed is:

1. A reciprocating coke guide extension, for use in conjunction with a horizontal coke oven, comprising:

(a) a coke guide aligned, when in use, with said coke oven, further comprising:
  (i) a rectangular vertical right wall;
  (ii) a rectangular vertical left wall;
  (iii) a rectangular horizontal floor connected, at its side edges, to the lower edges of said right wall and said left wall in the form of a channel;
(b) a vertical right wing the vertical rear edge of which is positioned adjacent to the vertical front edge of said right wall, being the edge of said right wall which is remote from said coke oven;
(c) means for pivotally connecting said front edge of said right wall to said read edge of said right wing;
(d) a vertical left wing the vertical rear edge of which is positioned adjacent to the vertical front edge of said left wall, being the edge of said right wall which is remote from said coke oven;
(e) means for pivotally connecting said front edge of said left wall to said rear edge of said left wing;
(f) means for pivoting said right wing;
(g) means for pivoting said left wing;
(h) a floor extension coextensively positioned to the front edge of said floor, being the edge of said floor remote from said coke oven, said floor extension being as wide as the summation of the lengths of said right wing and said left wing and the width of said floor, said floor extension being reciprocatingly mounted to extend beyond and retract from said front edge of said floor;
(i) means to linearly guide the motion of said floor extension;
(j) means to reciprocate said floor extension in a linear direction from a retracted position where the leading edge of said floor is adjacent to said front edge of said floor to an extended position where the trailing edge of said floor extension is adjacent to said front edge of said floor.

2. A reciprocating coke guide extension as recited in claim 1 in which said right wing and said left wing are approximately equal in horizontal length and said horizontal length is between three feet and five feet.

3. A reciprocating coke guide extension as recited in claim 1 in which said means for pivotally connecting said front edge of said right wall to said read edge of said right wing comprises a plurality of hinges, the legs of each respectively mounted adjacent said right wall and said right wing, said hinges aligned to form a common pivotal axis at the juncture formed by said front edge of said right wall and said rear edge of said right wing.

4. A reciprocating coke guide extension as recited in claim 1 in which said means for pivotally connected said front edge of said left wall to said rear edge of said left wing comprises a plurality of hinges, the legs of each respectively mounted adjacent left wall of said left wing, said hinges aligned to form a common pivotal axis at the juncture formed by said front edge of said left wall and said rear edge of said left wing.

5. A reciprocating coke guide extension as recited in claim 1 in which said means for pivoting said right wing comprises:

(a) a double acting hydraulic right wing cylinder;

(b) a linear right wing extension mounted within said right wing cylinder and pivotally connected at its remote end to said right wing;

(c) means for pivotally mounting said right wing cylinder proximately adjacent to said right wall, exterior to said coke guide, positioned to pivot said right wing about said hinges from a left 45° angle to said right wall, through an arc, to a right 90° angle to said right wall.

6. A reciprocating coke guide extension as recited in claim 1 in which said means for pivoting said left wing comprises:

(a) a double acting hydraulic left wing cylinder;

(b) a linear left wing extension mounted within said left wing cylinder and pivotally connected at its remote end to said left wing;

(c) means for pivotally mounting said left wing cylinder proximately adjacent to said left wall, exterior to said coke guide, positioned to pivot said left wing about said hinges from a right 45° angle to said left wall, through an arc, to a left 90° angle to said left wall.

7. A reciprocating coke guide extension as recited in claim 1 in which said floor extension, when fully extended, protrudes beyond said front edge of said floor a distance of from 3 feet to 5 feet.

8. A reciprocating coke guide extension as recited in claim 1 in which said means to reciprocate said floor extension comprises:

(a) a plurality of horizontally positioned double acting hydraulic floor cylinders aligned with the linear direction of movement of said floor extension;

(b) a plurality of cylinder rods mounted within said floor cylinders and connected adjacent to the leading edge of said floor extension.

9. A reciprocating coke guide extension as recited in claim 1 in which said means to linearly guide the motion of said floor extension comprises:

(a) a pair of channels, each oppositely positioned to the other about each side edge of said floor extension, parallel to each other and substantially contacting said floor extension at all positions of reciprocation of said floor extension;

(b) means of rigidly fixing said channels to encompass said floor extension.

10. A reciprocating coke guide extension as recited in claim 1 in which said coke guide is mounted on a coke guide car.

11. A reciprocating coke guide extension as recited in claim 10 in which said means for pivoting said right wing, said means for pivoting said left wing, said means to linearly guide the motion of said floor extension, and said means to reciprocate said floor extension are all mounted on said coke guide car.

12. A reciprocating coke guide extension, mounted on a coke guide car, for use in conjunction with a horizontal coke oven, comprising:

(a) a coke guide aligned, when in use, with said coke oven, further comprising:

(i) a rectangular vertical right wall;

(ii) a rectangular vertical left wall;

(iii) a rectangular horizontal floor connected, at its side edges, to the lower edges of said right wall and said left wall in the form of a channel;

(b) a vertical right wing, less in vertical height than said right wall, the horizontal width of said right wing being between three feet and five feet, the vertical rear edge of which is positioned adjacent to the vertical front edge of said right wall, being the edge of said right wall which is remote from said coke oven;

(c) a vertical left wing, equal in vertical height and horizontal width to said right wing, the vertical rear edge of which is positioned adjacent to the vertical front edge of said left wall, being the edge of said left wall which is remote from said coke oven;

(d) a plurality of hinges, divided into two sets of one or more of said hinges in each set, each set of said hinges, respectively, pivotally connecting said right wing to said right wall and said left wing to said left wall, the first set of hinges positioned to form a common pivotal axis at the juncture formed by said front edge of said right wall with said rear edge of said right wing, the second set of said hinges positioned to form a common pivotal axis at the juncture formed by said front edge of said left wall with said read edge of said left wing;

(e) a plurality of double acting hydraulic wing cylinders arranged in two sets of one or more of said wing cylinders in each set, the first set of said wing cylinders positioned proximately adjacent to said right wall, exterior to said coke guide, the second set of said wing cylinders positioned proximately adjacent to said left wall, exterior to said coke guide;

(f) a plurality of wing cylinder extensions, each mounted within each of said wing cylinders, said wing cylinder extensions which are mounted within said first set of said wing cylinders being pivotally connected to said right wing, said wing cylinder extensions which are mounted within said second set of said wing cylinders being pivotally connected to said left wing;

(g) a pair of stanchions, one each for each said set of wing cylinders, each fixed at its base to sad coke guide car, the first said stanchion positioned beneath said first set of said wing cylinders and pivotally connected thereto, the second said stanchion positioned beneath said second set of said wing cylinders and pivotally connected thereto;

(h) a floor extension coextensively positioned to the edge of said floor, being the edge of said floor remote from said coke oven, said floor extension being as wide as the summation of the lengths of said right wing and said left wing and the width of said floor, said floor extension being reciprocatingly mounted to extend beyond and retract from said front edge of said floor, said floor extension, when fully extended being of sufficient length to protrude beyond said front edge of said floor a distance of from 3 to 5 feet;

(i) a pair of channels, oppositely positioned each to the other but parallel to each other, fitted about each side edge of said floor extension, substantially connecting said floor extension at all positions of reciprocation of said floor extension, said channels being fixed to said coke guide car;

(j) a plurality of horizontally positioned double acting hydraulic floor cylinders fixed, parallel to each other, to said coke guide car an aligned with the linear direction of movement of said floor extension;

(k) a plurality of cylinder rods, each mounted within one of said cylinders, the remote ends of said cylinder rods being connected to the leading edge of said floor extension.

* * * * *